US007328665B2

(12) United States Patent
Konig et al.

(10) Patent No.: US 7,328,665 B2
(45) Date of Patent: Feb. 12, 2008

(54) EMBROIDERY MODULE FOR A FREE-ARM SEWING MACHINE

(75) Inventors: Michael Konig, Constance (DE); Andre Stucki, Steckborn (CH); Markus Muller, Fruthwilen (CH)

(73) Assignee: Fritz Gegauf AG, Steckborn (CH)

( * ) Notice: Subject to any disclaimer, the term of this patent is extended or adjusted under 35 U.S.C. 154(b) by 0 days.

(21) Appl. No.: 11/552,167

(22) Filed: Oct. 24, 2006

(65) Prior Publication Data

US 2007/0101917 A1 May 10, 2007

(30) Foreign Application Priority Data

Nov. 7, 2005 (CH) ..... 01781/05

(51) Int. Cl.
*D05B 21/00* (2006.01)
*D05C 9/04* (2006.01)

(52) U.S. Cl. ..... 112/470.18

(58) Field of Classification Search ..... 112/103, 112/102.5, 470.06, 470.09, 470.14, 470.18, 112/258, 261
See application file for complete search history.

(56) References Cited

U.S. PATENT DOCUMENTS 3,995,573 A * 12/1976 Nishigami et al. ..... 112/258
5,040,476 A * 8/1991 Takenoya et al. ..... 112/102.5
5,906,168 A 5/1999 Ito et al.
6,019,052 A 2/2000 Stucki et al.
6,035,792 A * 3/2000 Yoshida ..... 112/103
6,158,365 A * 12/2000 Hidechika et al. ..... 112/103
6,293,212 B1 * 9/2001 Ebata et al. ..... 112/103
6,802,272 B2 * 10/2004 Ebata et al. ..... 112/102.5
2004/0060493 A1 4/2004 Ebata et al.
2005/0072346 A1 4/2005 Yoshihisa

FOREIGN PATENT DOCUMENTS

JP 402080083 A * 3/1990

* cited by examiner

*Primary Examiner*—Ismael Izaguirre
(74) *Attorney, Agent, or Firm*—Volpe and Koenig, PC

(57) ABSTRACT

An embroidery module (1) is provided that is attached (docked) to the base plate (29) of a sewing machine (27) and supplied with power and control commands from the machine electronics. A free space (33), which permits the insertion of tubular work pieces around the free arm (31), is created between the embroidery module (1) and a front end of the free arm (31). The embroidery module (1), with or without an embroidery hoop support (13), can remain docked for all sewing, embroidery, and quilting work on the sewing machine (27).

9 Claims, 5 Drawing Sheets

EMBROIDERY MODULE FOR A FREE-ARM SEWING MACHINE

BACKGROUND

The subject matter of the invention is an embroidery module for a free-arm sewing machine.

Free-arm sewing machines for home use have a relatively small work surface, in order also to be able to process tubular work pieces, such as sleeves, etc. For better support of larger work pieces, so-called slide-on extension tables, which have a U-shaped configuration and which enclose the free arm on three sides, are frequently supplied with the sewing machine. This significantly larger work and support surface, however, prevents the sewing or embroidering of tubular sewing material.

The work surface can also be expanded for large work pieces by docking an embroidery module, which is used for driving and supporting an embroidery hoop. Here, it is disadvantageous that after the work is performed, the slide-on extension table or the embroidery module must be removed again, in order to be able to perform different work on the sewing machine.

SUMMARY

One objective of the present invention is to create an embroidery module, which can be used both for its main purpose, namely the driving and guiding of an embroidery hoop, but also continuously as an enlarged work surface, without having to limit the possibilities of the free-arm sewing or free-arm embroidery for tubular work pieces when the embroidery module is docked.

This objective is met by the present invention.

This objective is achieved without issue in various respects by the configuration of the embroidery module according to the invention. Here, not only is the use of the embroidery module as an expanded work surface advantageous thanks to the embroidery hoop support that can be completely removed from the embroidery module, but also an embroidery hoop support for larger embroidery hoops, which is consequently long due to the large edge length of such embroidery hoops, can be stored separately from the embroidery module. For most sewing work, the embroidery module can always remain coupled to the sewing machine without the embroidery hoop support or it is advantageous to keep this module docked to the machine. For individual applications, in which the properties of the free arm are required, the embroidery module can also remain docked.

On the other hand, the latter construction can be removed from the machine when only tubular work pieces are to be processed for a long time, in contrast to embroidery hoop drives connected permanently to the machine. The mounting of the embroidery hoop support in guides, which are located at the sides of the embroidery module, prevents dust or sewing instruments, e.g., needles or cut threads, from reaching into the guide rails. In addition, the slot-free surface of the embroidery module forms a closed material support that does not interfere with the movement of the material when sewing or embroidering.

BRIEF DESCRIPTION OF THE DRAWINGS

The invention is explained in more detail with reference to an illustrated embodiment. Shown are.

DETAILED DESCRIPTION OF THE PREFERRED EMBODIMENTS

Figure 1:
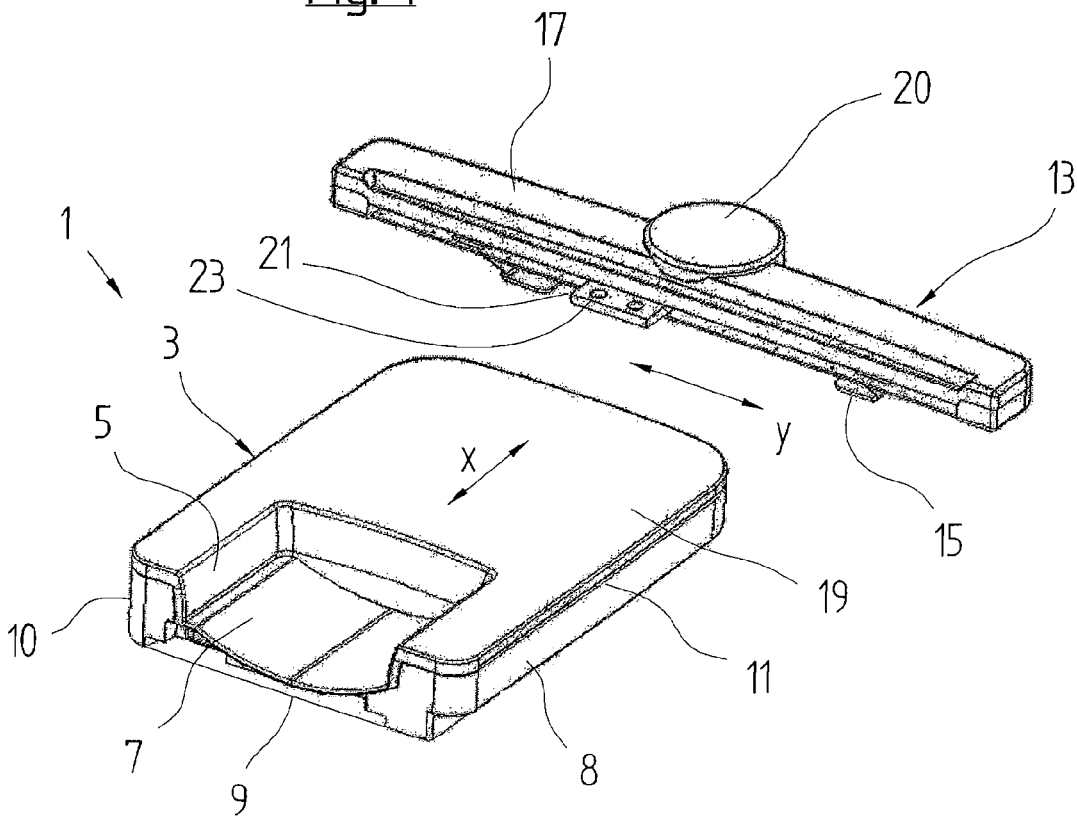
FIG. 1 is a perspective view of an embroidery module with the embroidery hoop support removed.
Figure 2:
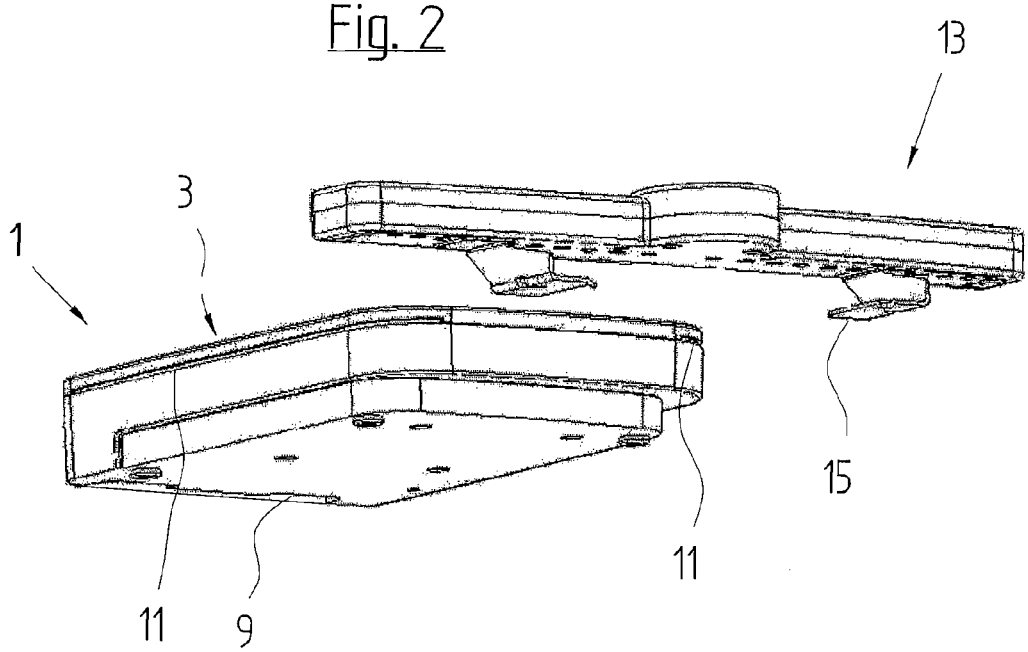
FIG. 2 is a perspective bottom view of an embroidery module with the embroidery hoop support removed.

The embroidery module 1 shown in FIGS. 1 and 2 includes a main body 3 with an essentially rectangular outline. A recess 5, which can be open at the bottom or can have an approximately v-shaped or cylindrical shell-shaped base 7, as in the shown configuration, is visible on one of the two narrow sides. Underneath the base 7, a base plate 9 extending over the entire main body 3 can be attached. In the two longer side surfaces 8, 10 of the embroidery module 1, slots 11 extending on the side of the narrow-side recess 5 up to or only approximately up to the end of the embroidery module 1 are formed parallel to its upper surface. In contrast, on the opposite narrow side, they are open. Within the embroidery module 1 are drives, such as toothed belts, round belts, metal bands, cords, or shafts, which can transport an embroidery hoop support 13 guided in the X-direction exactly parallel through the use of suitable couplings. The drives for the embroidery hoop support 13, which are not shown in the figures, because they are not visible, are driven by at least one first electric motor inserted within the embroidery module 1. The embroidery hoop support 13 is connected to a transport device located behind the slots 11 by brackets 15 (cf. FIG. 2), which engage through the slots 11 into the not-described and not-visible couplings. The brackets 15 are dimensioned so that an intermediate space exists between the elongated housing 17 of the embroidery hoop support 13 and the work surface 19 on the embroidery module 1. That is, the embroidery hoop support 13 or the embroidery hoop 25 does not contact the surface of the embroidery module 1.

In the housing 17 of the embroidery hoop support 13, a second drive motor for an embroidery hoop adapter 21 is provided, which is mounted so that it can move in the Y-direction in the embroidery hoop support 13, in the cylindrical section 20 in the center in FIGS. 1 and 2. The embroidery hoop adapter 21 can have, for example, bores 23, in which an embroidery hoop 25 can be fixed (cf. FIGS. 5 and 6).

Below, the embroidery module 1 is described in more detail in combination with a household sewing machine 27, i.e., docked to such a machine.

Figure 3A:
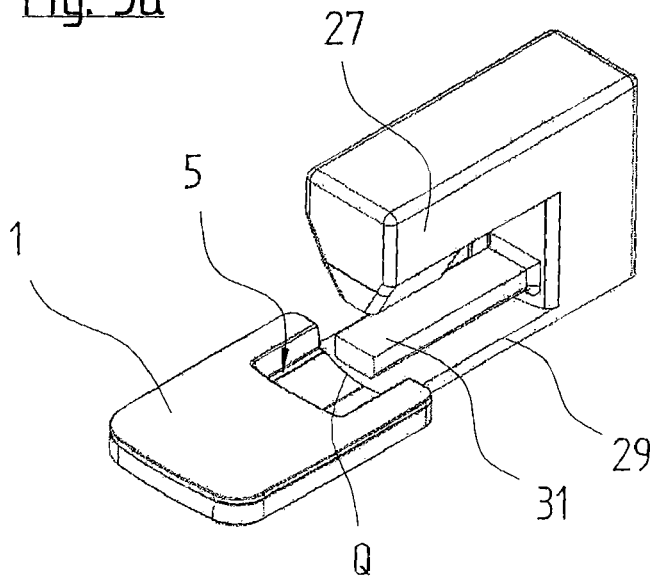
FIG. 3*a* is a perspective view of a sewing machine with docked embroidery module.
Figure 3B:
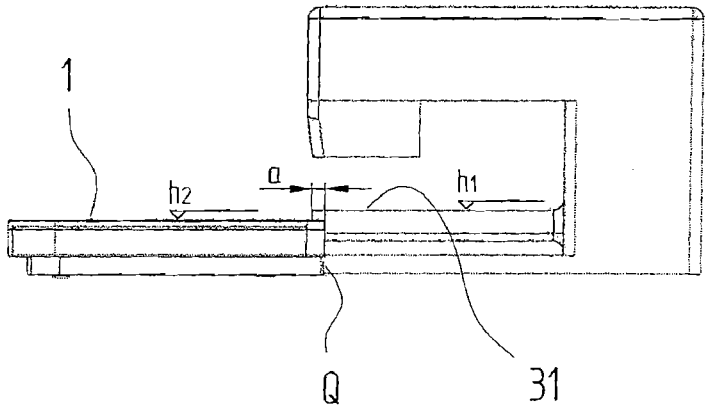
FIG. 3*b* is a side view of the sewing machine with docked embroidery module.
Figure 3C:
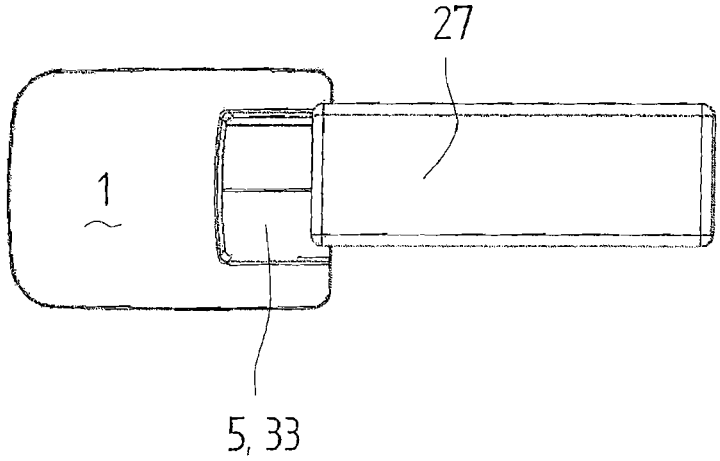
FIG. 3*c* is a top view of a sewing machine with docked embroidery module.

In FIGS. 3*a* to 3*c*, it can be seen that the embroidery module 1 is fixed at the end along the edge Q to the end surface of the base plate 29 of the sewing machine 27 and that the free arm 31 projects only by a small amount a into the recess 5 on the embroidery module 1. The other area of the recess 5 in the embroidery module 1 is not filled by a part of the sewing machine 27, but instead is used as a free space 33 for inserting, e.g., tubular sewing material over the free arm 31. In the arrangement described now (FIGS. 3*a-c* and 4*a-c*), the embroidery module 1 is used solely as an enlarged work surface, i.e., as a sewing-material support especially when sewing large surface area work pieces. To further expand the sewing-material support, a slide-on extension table 35 can be attached, which can also be docked to the free arm 31 of the sewing machine without an embroidery module 1. Therefore, on one hand the free space 33 formed by the recess 5 is closed at the top and on the other hand the contact surface on the sewing machine is further expanded (cf. FIGS. 4*a* to 4*c*) in front of and behind the free arm 31 (viewed in the direction of sewing). In this arrangement, it is obvious that the processing of tubular work pieces is not possible. For this purpose, as shown in FIGS. 3*a* to 3*c*, the slide-on extension table 35 must be removed. So that the slide-on extension table 35 forms a plane with the surface of the free arm 31 when the embroidery module is docked, the surface of the embroidery module 1 lies at the height $h_2$, i.e., offset by the thickness d of the slide-on extension table (35), deeper than the surface of the free arm 31, which lies at the height $h_1$ ($h_1-h_2=d$). This difference in height between the surface of the free arm 31 and that of the embroidery module 1 does not interfere with sewing or embroidering without the slide-on extension table 35. In contrast, these steps optimize the accessibility of the free space 33 between the embroidery module 1 and the free space 31.

Figure 4A:
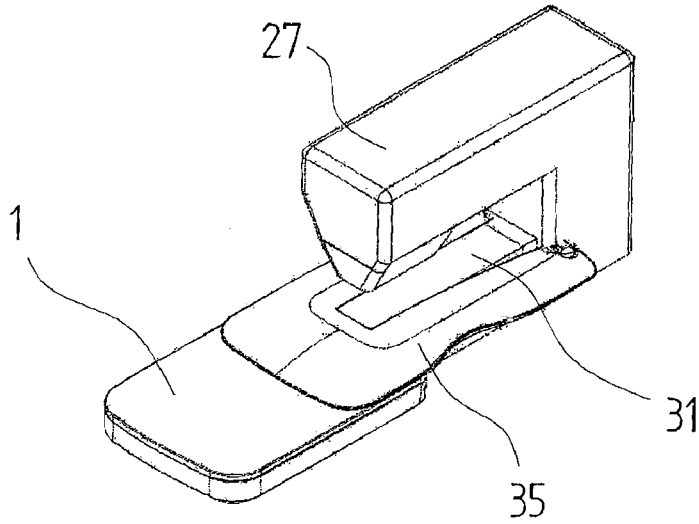
FIG. 4*a* is a perspective view of the sewing machine with docked embroidery module and coupled slide-on extension table.
Figure 4B:
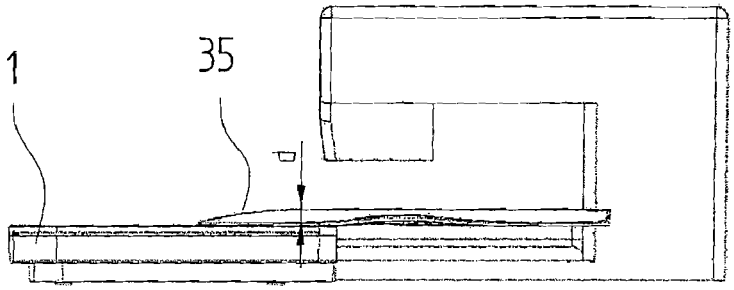
FIG. 4*b* is a side view of the sewing machine with coupled slide-on extension table.
Figure 4C:
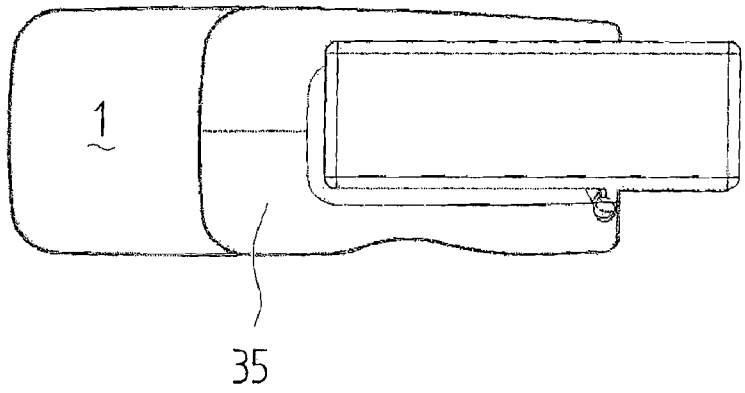
FIG. 4*c* is a top view of a sewing machine with coupled slide-on extension table.
Figure 5A:
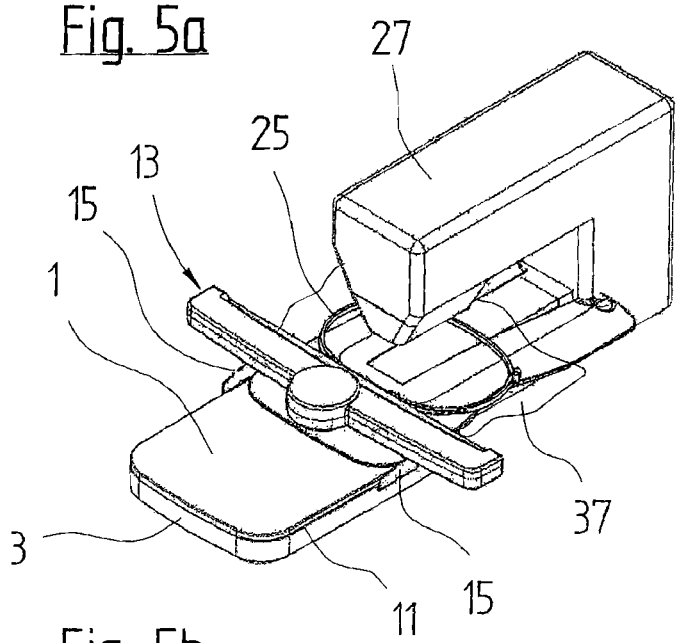
FIG. 5*a* is a perspective view of the sewing machine and the embroidery module with coupled embroidery hoop support, as well as the embroidery hoop and the slide-on extension table.
Figure 5B:
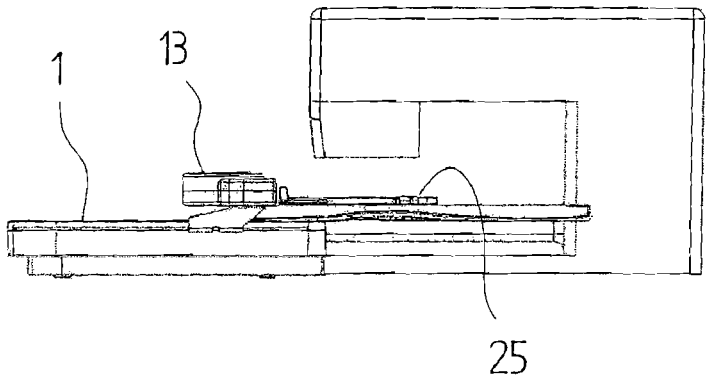
FIG. 5*b* is a side view of the sewing machine and the embroidery module with coupled embroidery hoop support, as well as embroidery hoop with slide-on extension table.
Figure 5C:
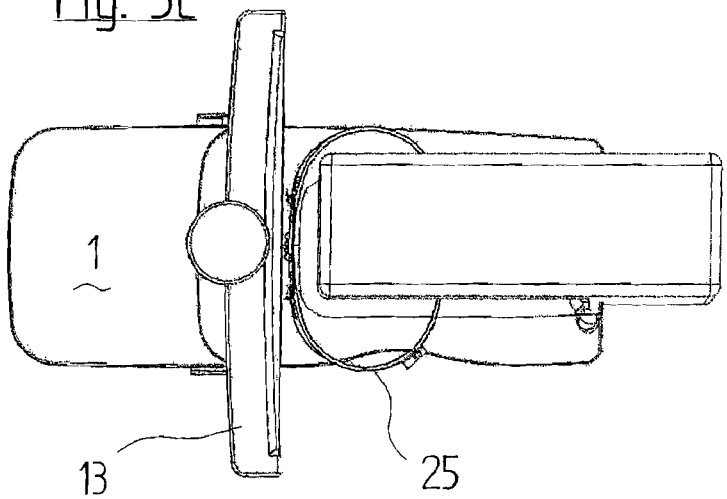
FIG. 5*c* is a top view of a sewing machine and the embroidery module with coupled embroidery hoop support, as well as embroidery hoop with slide-on extension table.

In FIGS. 5*a*-5*c* and to 6*a*-6*c*, the embroidery hoop support 13 is placed on the embroidery module 1. This is supported by the two brackets 15, which engage in the side slots 11 on the foundation 3 of the embroidery module 1. The embroidery hoop 25 is fixed on the embroidery hoop support 13, with which sewing material 37 held in tension on the hoop is mounted so that it can move via a computer-assisted program under the needle (not shown) of the sewing machine 27 in the x-direction and the y-direction. The embroidery hoop 25 here lies on the slide-on extension table 35, as is shown in FIGS. 4*a* to 4*c*.

Figure 6A:
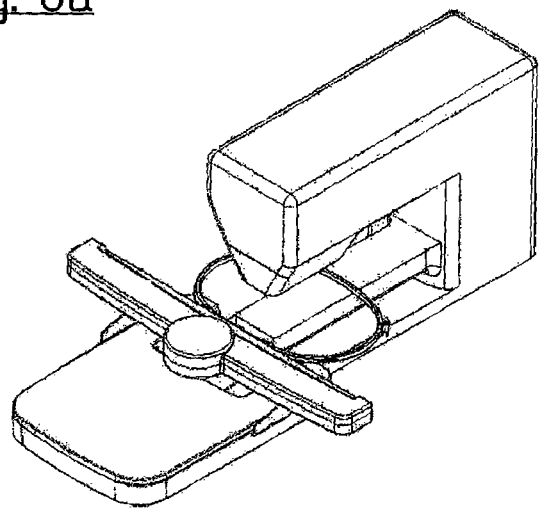
FIG. 6*a* is a perspective view of the sewing machine, the embroidery module, and coupled embroidery hoop support without slide-on extension table.
Figure 6B:
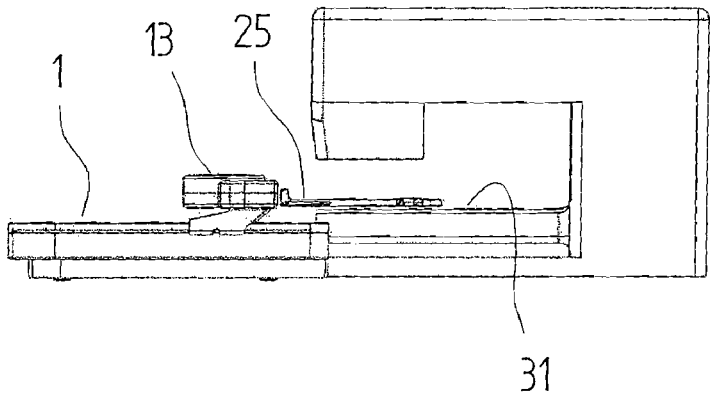
FIG. 6*b* is a side view of the sewing machine, the embroidery module, and coupled embroidery hoop support without slide-on extension table.
Figure 6C:
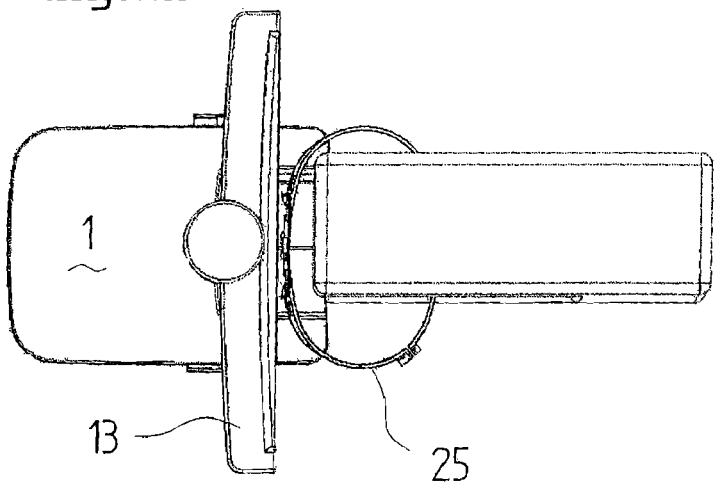
FIG. 6*c* is a top view of a sewing machine and the embroidery module with coupled embroidery hoop support without slide-on extension table.

In the representation according to FIGS. 6*a* to 6*c*, the embroidery hoop 25 lies directly on the surface of the free arm 31. That is, the free space 33, formed by the recess 5, is not closed at the top and the free arm 31 itself is free at the side. Consequently, tubular work pieces or also hemispherical work pieces, such as caps, can also be tensioned in the embroidery hoop 25. The non-tensioned part of this sewing material can move without interference around the free arm 31 during the sewing or embroidering.

In the four embodiments of the embroidery module 1 according to the invention, the module does not have to be removed from the sewing machine 27. Consequently, all of the work performed on a sewing machine 27 can also be performed when the embroidery module 1 remains docked. A lot of sewing work, in which the embroidery module 1 is not needed, can benefit from this module, however, when it is docked for sewing, quilting, or embroidery. The embroidery hoop support 13, which is not needed for work without the embroidery hoop 25, can be removed easily from the embroidery module 1 without a tool and placed to the side.

LEGEND

1 Embroidery module
3 Main Body of 1
5 Recess
7 Base of 5
8 Side surface
9 Base plate
10 Side surface
11 Slot
13 Embroidery hoop support
15 Brackets
17 Housing
19 Work surface on the embroidery module
20 Cylindrical section
21 Embroidery hoop adapter
23 Bores
25 Embroidery hoop
27 Sewing machine
29 Base plate of 27
31 Free arm
33 Free space
35 Slide-on extension table
37 Sewing material

The invention claimed is:

1. Embroidery module (1) for a free-arm household sewing machine (27) comprising a main body (3) with a work surface used as a work piece support, the main body (3) is constructed as a housing for embroidery hoop drive elements and as a connection element for connecting the embroidery module (1) to the sewing machine (27), an embroidery hoop support (13) mounted for movement on the embroidery module (1) on guides in slots (11) in an X-direction so that the embroidery hoop support can be driven by a first drive, an embroidery hoop adapter (21) connected to the embroidery hoop support for movement in a Y-direction and that can be driven by a second drive, the work surface is provided on the main body (3), such that edges of the work surface that are located adjacent to the free arm (31) are spaced apart from three side surfaces of the free arm (31) after the embroidery module (1) is fixed to a base plate (29) of the sewing machine (27), and the slots (11) and the drive in the main body (3) are constructed, such that the embroidery hoop support (13) is disengagable from the slots (11) in the embroidery module (1) and can be removed completely from the first drive and from the embroidery module (1).

2. Embroidery module according to claim 1, wherein a drive motor is arranged in the embroidery hoop support (13) as the second drive for driving the embroidery hoop adapter (21) in the Y-direction.

3. Embroidery module according to claim 2, wherein the surface of the embroidery module (1) lies parallel to a surface of the free arm (31) but at a lower level ($h_2$) and a difference in height levels ($h_1$-$h_2$) therebetween corresponds to a thickness (d) of a slide-on extension table (35) that can be connected to the sewing machine (27).

4. Embroidery module according to claim 1, wherein a recess (5), which provides free access to the free arm (31) on all sides, is formed in front of the free arm (31) in the work surface when the embroidery module (1) is docked, and the embroidery module (1) does not engage under the free arm (31) at all or only partially and engages in a free space (33) between the base plate (29) and a bottom side of the free arm (31) while leaving an open gap.

5. Embroidery module according to claim 1, wherein the embroidery hoop support (13) includes two supports or brackets (15), which engage in the slots (11) formed on the sides in the main body (3) and which can be connected to the first drive in the main body (3).

6. Embroidery module according to claim 5, wherein the slots (11) are open at least on one end of the main body (3) and enable insertion and removal of the embroidery hoop support (13) from the docked embroidery module (1).

7. Embroidery module according to claim 1, wherein the work surface of the embroidery module (1) is narrower, equal to, or wider than a width of the free arm (31) at a top side thereof.

8. Embroidery module according to claim 7, wherein a usable surface of the free arm (31) can be expanded by a slide-on extension table (35) for at least the width of the work surface of the embroidery module (1), and the recess (5) between the free arm (31) and the embroidery module (1) can be covered at a top thereof.

9. Embroidery module according to claim 1, wherein a slide-on extension table (35) can be used both on the sewing machine (27) without a docked embroidery module (1) and also on the sewing machine (27) with a docked embroidery module (1).

* * * * *